United States Patent [19]

Tokuno et al.

[11] Patent Number: 4,612,006

[45] Date of Patent: Sep. 16, 1986

[54] DIE CUTTING APPARATUS

[75] Inventors: Masateru Tokuno, Nishinomiya; Tetsuya Sawada, Kyoto, both of Japan

[73] Assignee: Rengo Co., Ltd., Osaka, Japan

[21] Appl. No.: 651,767

[22] Filed: Sep. 18, 1984

[30] Foreign Application Priority Data

Sep. 30, 1983 [JP] Japan ..... 58-182549

[51] Int. Cl.[4] ..... B31B 1/20; B26D 7/18

[52] U.S. Cl. ..... 493/342; 493/82; 493/83; 83/103; 83/107; 83/155.1; 83/151

[58] Field of Search ..... 83/100, 101, 103, 107, 83/112, 151, 155, 155.1; 493/64, 82, 83, 342

[56] References Cited

U.S. PATENT DOCUMENTS

| | | | |
|---|---|---|---|
| 2,711,676 | 6/1955 | Richardson et al. | 493/342 |
| 3,391,589 | 7/1968 | Bishop | 83/103 |
| 3,653,304 | 4/1972 | Lenoir | 493/342 |
| 4,026,199 | 5/1977 | Adams et al. | 493/342 |

*Primary Examiner*—Donald R. Schran

*Attorney, Agent, or Firm*—Wenderoth, Lind & Ponack

[57] ABSTRACT

An improved die cutting apparatus separates the gripper margin from the product portion and the releases the gripper margin from the gripper at the same station, i.e. at a pair of rolls. Further, the gripper margin is re-held and re-released at the pair of the rolls to prevent the gripper margins from becoming up with the product portions.

4 Claims, 9 Drawing Figures

DIE CUTTING APPARATUS

BACKGROUND OF THE INVENTION

The present invention relates to a die cutting apparatus for cutting blanks of corrugated fiberboard, paper, metal, plastics and other materials, and particularly to a unit for separating what is called a gripper margin from a product portion and releasing the gripper margin.

A conventional die cutting apparatus comprises a blank feed unit, an endless conveyor having grippers for holding the blanks to be die-cut, a die cutting unit of a rotary or flat type, a unit for separating the scrap portion, a unit for separating the gripper margin from the product portion, and a unit for releasing the gripper margin from the gripper. By passing each blank held by gripper through these units one after another, the products cut out to a required shape can be obtained continuously.

In such a conventional apparatus, after the blank has been die-cut, the scrap portion is firstly separated from the product portion with the gripper margin. The gripper margin is then separated from the product portion, which falls and is collected. Finally, the gripper margin is released from the gripper at the upper portion of the apparatus. The scrap portions and the gripper margin thus separated are taken out of the apparatus by means of separate conveyors.

As described above, in the conventional die cutting apparatus, the release of the gripper margin from the gripper is performed some time after the separation of the gripper margin from the product portion. Therefore, the margin releasing unit has to be provided at a distance from the margin separating unit to prevent the gripper margins from becoming mixed up with the product portion. This necessitates the use of separate conveyors and thus complicates the structure of the apparatus and increases the manufacturing cost.

BRIEF SUMMARY OF THE INVENTION

An object of the present invention is to provide a die cutting apparatus which is simpler in construction, smaller in size and less expensive.

In accordance with the present invention, the gripper margin is separated from the product portion and released from its holding member such as a gripper at the same station and both the gripper margin and the scrap portions are discharged on a single conveyor.

Each blank held by the gripper passes through the die cutting unit and the scrap separating unit and reaches the unit to which the present invention mainly relates. As soon as the gripper comes between the notches in the upper and lower rollers, the product portion gets nipped between the upper and lower rollers whereas the gripper margin is separated from the product portion, held by the margin re-holding member which may comprise a plurality of pins, and released from the grippers. These three operations are performed substantially at the same time. As the upper and lower rollers turn, the product portion is fed forwardly whereas the gripper margin now held by the re-holding member turns around one of the rollers and is released from the margin re-holding member by a scraper.

BRIEF DESCRIPTION OF THE DRAWINGS

Other objects and features of the present invention will become apparent from the following description taken with reference to the accompanying drawings in which.

DETAILED DESCRIPTION OF THE PREFERRED EMBODIMENT

Figure 1:
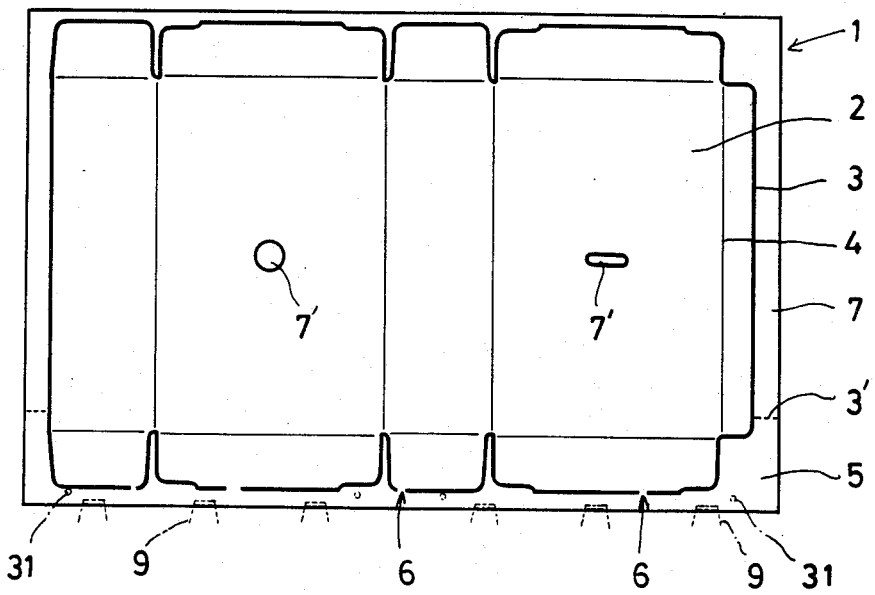
FIG. 1 is a plan view of a blank immediately after die-cutting.

FIG. 1 shows a blank 1 of corrugated fiberboard die-cut to obtain a product portion 2 from which a box is to be made. The blank 1 has been die-cut as indicated by thick lines 3 and has had fold lines 4 (shown with thin lines) formed therein. The die-cut line 3 in a gripper margin 5 is not continuous at portions 6 through which the product portion 2 is still connected to the gripper margin 5. Perforations 3' are formed between the gripper margin 5 and a portion to be scrapped 7 to separate the scrap portion 7 at a scrap separator 16 (described later).

The gripper margin 5 is a portion at which the blank 1 is to be gripped by grippers 9 and to be pinned by pins 31. Cutout holes 7', too, are portions to be scrapped.

Figure 2:
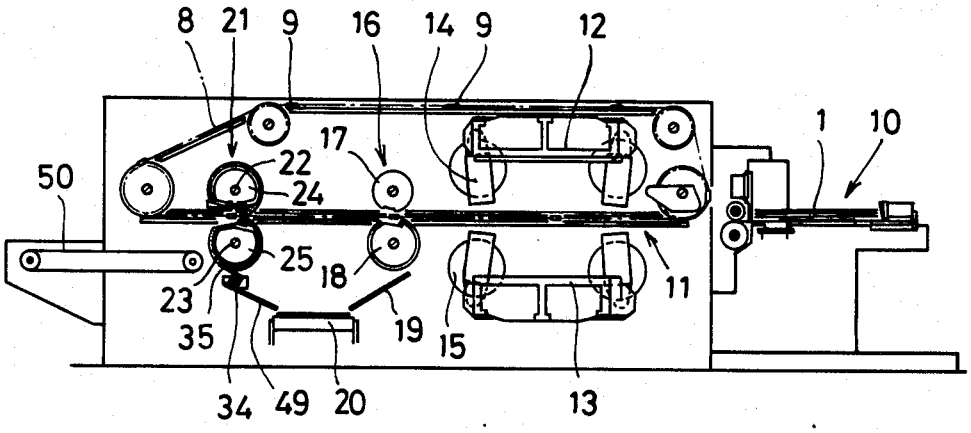
FIG. 2 is a schematic view of the entire die cutting apparatus.

FIG. 2 shows an entire die-cutting apparatus which has an endless conveyor comprising a chain conveyor 8 having the grippers 9 attached thereto at regular intervals as the blank holding members. The grippers 9 are adapted to open only for a short time at the rear end of the apparatus to grip a blank 1 fed from a blank feed unit 10 at a timing set to correspond to the opening of the gripper. The blank gripped by the grippers 9 passes through a die-cutting unit 11 which as a blade 12 opposed to an anvil 13, the blade and the anvil being supported by rotary arms 14, 15, respectively, which make one full turn for each die-cutting operation. While the blank 1 passes through the die-cutting unit 11, it is cut along the die-cut lines 3, 3' and shaped at the fold lines 4 as shown in FIG. 1.

The die-cut blank 1 then passes through a scrap separator 16 which has an opposed pair of rolls 17, 18. The upper roll 17 is provided with projections at positions corresponding to the portions 7, 7' to be scrapped and the lower roll 18 is provided with recesses to receive the projections. The scrap portions 7, 7' separated by the scrap separator 16 fall through a chute 19 on to a discharge conveyor 20.

The blank 1, now with the portions 7, 7' removed therefrom is then fed to a margin separator/releaser 21 where the gripper margin 5 is separated from the product portion 2. This unit 21 is the main unit to which the present invention relates.

Figure 3:
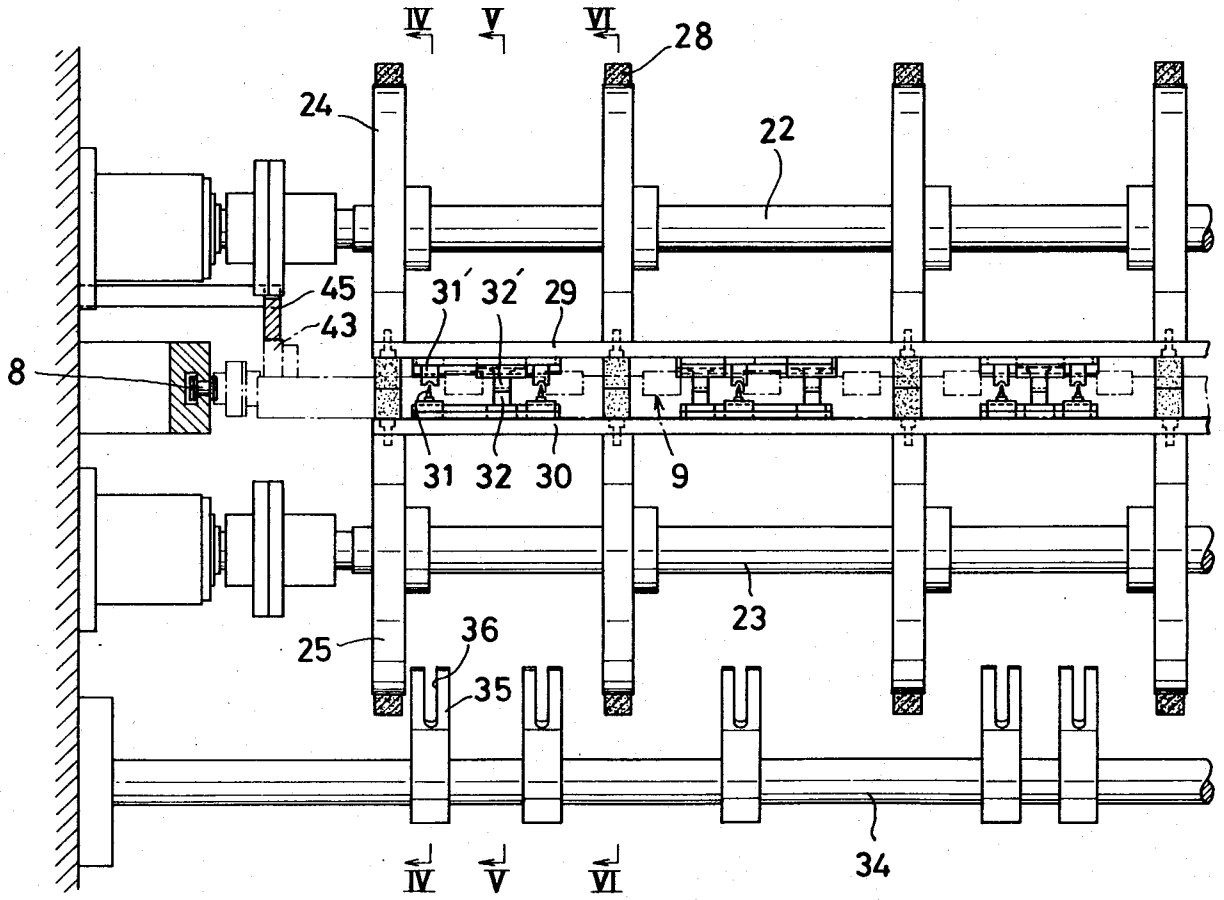
FIG. 3 is an enlarged sectional view of the margin separator/releaser unit.

The margin separator/releaser 21 has a plurality of rollers 24 and a plurality of rollers 25 mounted on an opposed pair of rotary shafts 22 and 23, respectively, at intervals (FIG. 3). The rollers 24 and rollers 25 have the same diameter and rotate in contact with each other in opposite directions.

Figure 6:
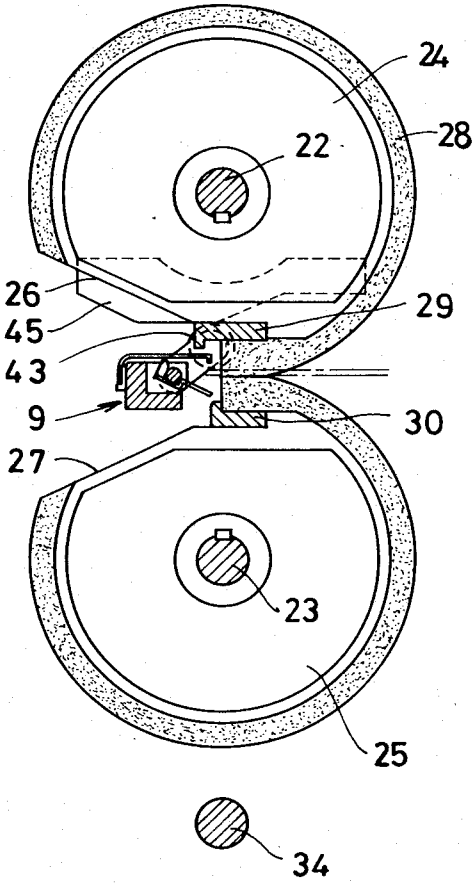
FIG. 6 is a sectional view taken along the line VI—VI of FIG. 3.
Figure 5:
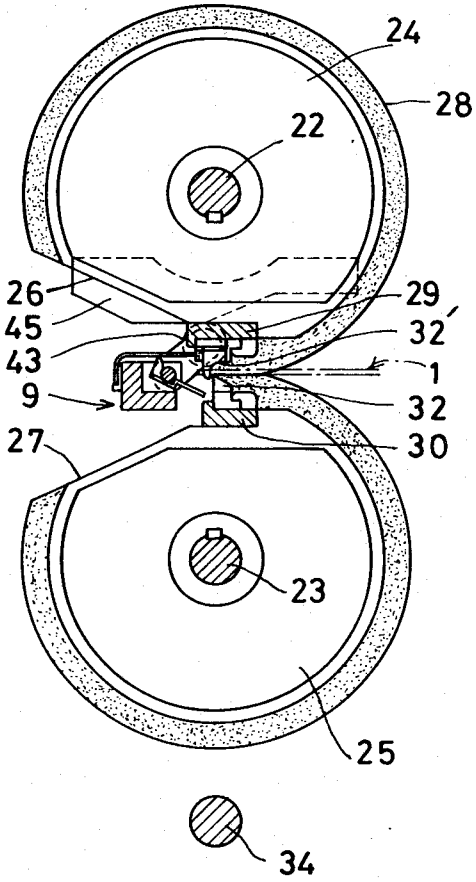
FIG. 5 is a sectional view taken along the line V—V of FIG. 3.
Figure 4:
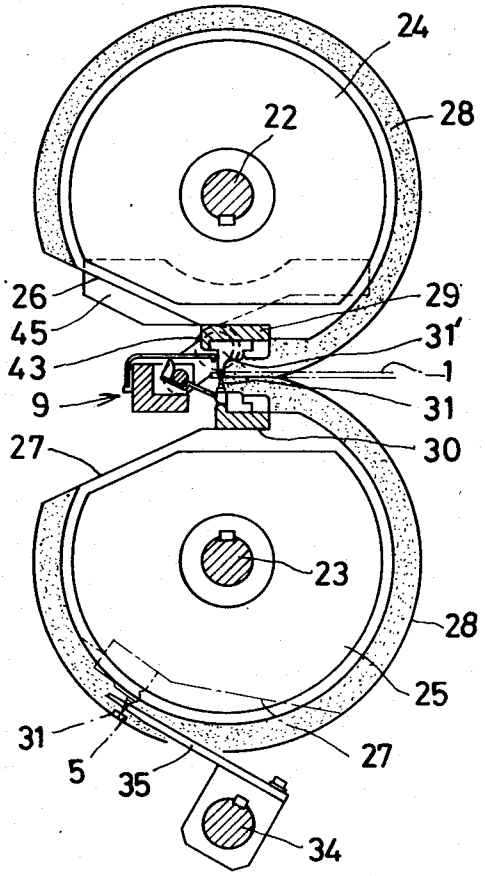
FIG. 4 is a sectional view taken along the line IV—IV of FIG. 3.

The rollers 24 and 25 are provided with respective notches 26 and 27, (FIGS. 4–6), which are opposed to each other with respect to the blank running track so as to afford a sufficient space for the grippers 9 to pass through between the rollers 24 and 25. The outer periphery of each roller 24 and 25 except for its notched portion is covered with a rubber layer 28 so that the rubber layers on the upper and lower rollers will be in close contact with each other while the rollers 24 and 25 are turning. The rubber layer 28 may be omitted. Instead, the outer peripheral surface of each roller 24 and 25 may be knurled for easy feeding of the blank out of the rollers. The upper and lower rollers 24, 25 may not be in contact with each other so long as they can nip the product portion 2 sufficiently to feed it out.

The upper rollers 24 are coupled together by a bar 29 and parallel to the shaft 22. Similarly, the lower rollers 25 are coupled together by a bar 30 parallel to the shaft 23. The bars 29, 30 are disposed at one side of the notches 26 and 27, respectively, i.e. at that side from which the blank enters between the rolls.

A plurality of radial pins 31 are fixedly mounted on the lower bar 30 at intervals therealong and pin receivers 31' are fixedly mounted on the upper bar 29 to cooperate with the pins 31 to ensure the pinning of the pins 31 to the gripper margin 5. The pins work as the margin re-holding members.

Also, a plurality of hammers 32 are mounted on the lower bar 30 at required intervals so as to extend radially and a plurality of anvils 32' are mounted on the upper bar 29 at corresponding positions. The hammers 32 cooperate with the anvils 32' to separate the gripper margin 5 from the product portion 2 by hammering the blank at the connecting portions 6. The hammers 32 may be mounted on the upper bar 29 in which case the anvils 32' are mounted on the lower bar 30.

After separation of the gripper margin 5, the product portion 2 is fed out of the rollers 24 and 25, nipped between the rubber layers 28.

Below the lower rotary shaft 23 there is a fixed shaft 34 parallel to the shaft 23. A plurality of scrapers 35 are fixedly mounted on the fixed shaft 34, opposed to the pins 31 (FIG. 3) to unpin the gripper margin 5 from the pins. The scrapers 35 are mounted tangentially with respect to the lower roller 25. (FIG. 4) As the roller 25 turns until its notch 27 comes to the position shown in FIG. 4 by a dotted line, the pins 31 enter grooves 36 in the scrapers 35 and gradually come out of them. At this time, the gripper margin 5 is unpinned or released from the pins 31 by the scrapers 35.

On the other hand, after the pins 31 have been pinned on the gripper margin, the grippers 9 open to release the gripper margin 5 when they pass between the upper and lower rollers 24 and 25.

Figure 7:
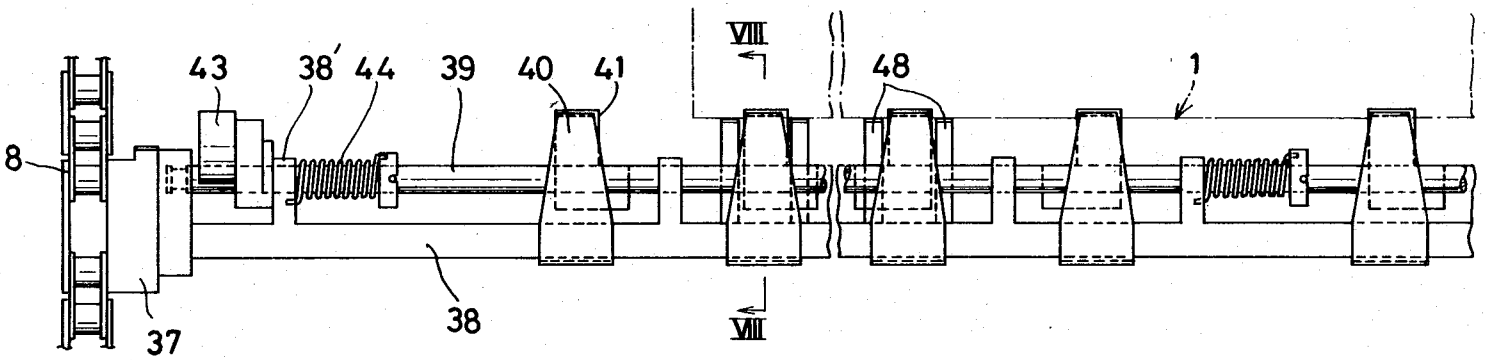
FIG. 7 is a partially cutaway plan view of the gripper.
Figure 9:
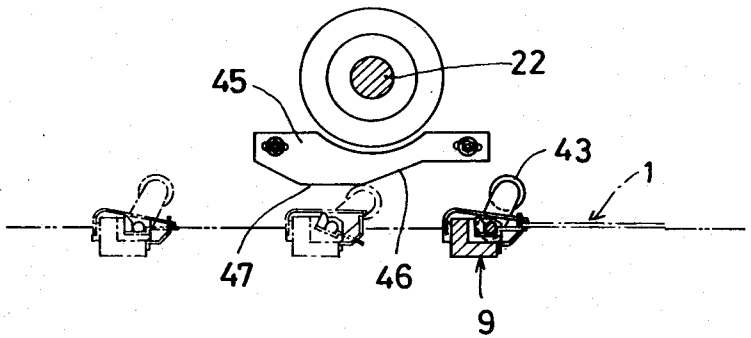
FIG. 9 is a sectional view showing how the cam plate acts on the gripper.
Figure 8:
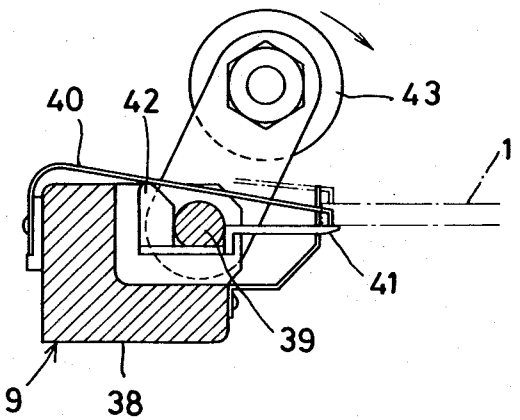
FIG. 8 is an enlarged sectional view taken along the line VIII—VIII of FIG. 7.

The grippers 9 will be described with reference to FIGS. 7–9. A fixed bar 38 and a turnable bar 39 parallel to each other are mounted on brackets 37 on the chains of chain conveyors 8 so as to extend the chain conveyors 8. A plurality of claws 40 in the form of L-shaped plate springs are mounted on the fixed bar 38 at required intervals and receiver claws 41 are fixedly mounted on the turnable bar 39 so as to cooperate with the claws 40 (FIG. 8). Each receiver claw 41 is provided at its rear end with a projection 42 adapted to abut the underside of the claw 40.

A cam follower 43 is mounted on the turnable bar 39 at one one thereof (FIG. 7) and is biassed against a cam plate 45 (FIG. 9) by a spring 44 held against a projection 38' on the fixed bar 38. The cam plate 45 is provided above the cam follower 43 mounted to the shaft 22 (FIGS. 3 and 9) and has a tapered surface 46 and a flat surface 47. The cam follower 43 is gradually pushed down by the tapered surface 46 on the cam plate 45 while the gripper 9 passes between the notches 26 and 27. After the pins 31 have been pinned on the gripper margin 5, the cam follower 43 is pivoted down by the flat surface 47 on the cam plate 45 to its lowermost position.

When the cam follower 43 is pivoted down by the contact with the cam plate 45, the turnable bar 39 integral with the cam follower turns clockwise by a required angle against the bias of the spring 44. Simultaneously, the receiver claw 41 will pivot down and the projection 42 will cause the claw 40 to pivot up so that the claws 40 and 41 will open. For some of the grippers 9, limiters 48 are mounted on the fixed bar 38 to prevent the blank 1 from getting caught by the gripper 9 too deep.

By means of the above described arrangement, when the blank 1 held by the grippers 9 passes through the margin separator/releaser unit 21, the gripper margin 5 is pinned by the pins 31 and simultaneously it is separated from the product portion 2 by hammering the connecting portions 6 with the hammers 32. The product portion 2 with the gripper margin 5 separated gets nipped between the upper and lower rollers 24 and 25.

As the gripper margin 5 pinned by the pins 31 turns by about one half turn with and around the lower roller 25, it is unpinned by the scrapers 35 and falls onto the discharge conveyor 20 through a chute 49. On the other hand, as the rollers 24 and 25 turn, the product portion 2 nipped between them is fed forward onto a product conveyor 50. Thus, the product portion 2 is taken out of the apparatus by the product conveyor 50, and the scrap portions 7, 7' and the gripper margin 5 are carried away by the discharge conveyor 20.

Although in the preferred embodiment the upper and lower rollers 24 and 25 are opposed to each other, and the pins 31 and the pin receivers 31' and the hammers 32 and the anvils 32' are mounted on the upper and lower bars 29 and 30, the rollers 24 and 25 may be replaced with a pair of elongated rollers and these members may be mounted directly on the rollers.

Although in the preferred embodiment the grippers are used to hold the blank on the gripper margin, pins, air suction or any other suitable holding means may be used. Similarly, although the gripper margin is caught by pins after separation from the product portion, it may be held by grippers, air suction or any other suitable means.

Although in the preferred embodiment a scraper is used to unpin the gripper margin to release it, air suction or any member acting directly on the margin reholding member to release the gripper margin may be used instead.

What is claimed is:

1. In a die cutting apparatus for die cutting blanks of corrugated fiberboard and like materials, said apparatus having a blank supply means, an endless blank conveyor means having blank holding members arranged at regular intervals for receiving blanks from the blank supply means and conveying the blanks through the apparatus, means positioned along the conveyor for die cutting the blanks to divide them into a product portion, a scrap portion and a gripper margin with the gripper margin being held by the blank holding members, and means positioned along the conveyor downstream of the die cutting means for separating the scrap portion from the product portion and the gripper margin, an improved gripper margin removal means spaced downstream of said scrap portion separating means and comprising:

a pair of opposed roller means having parallel axes of rotation, on opposite sides of said conveyor means for receiving and rollingly supporting the blank conveyed therebetween and means for rotating said pair of opposed roller means in opposite directions, about said axes, each roller means having a notch in the periphery thereof opposed to the notch in the periphery of the other roller means and axially aligned with the blank holding members so as to allow the blank holding members on the conveyor means to pass between said pair of roller means when said notches are opposed;

gripper margin separating means and gripper margin releasing means adjacent said pair of roller means for separating the gripper margin from the product portion and for releasing the gripper margin from the blank holding members;

means on one of said pair of roller means engaging the gripper margin for causing the gripper margin to be carried away from the conveyor means as said one roller means rotates; and means, operatively associated with said one roller means, for removing the gripper margin from said engaging means at a point spaced around the periphery of said one roller means from the point where the periphery of said one roller means is adjacent the conveyor means.

2. An improved gripper margin removal means as claimed in claim 1 in which each of said pair of roller means comprises a plurality of rollers and a common shaft on which said rollers are mounted at spaced intervals with the rollers on one shaft opposed to the rollers on the other shaft, arranged to receive the blank therebetween, an upper bar connected between the rollers on the shaft above the conveyor means and extending parallel to the shaft, and a lower bar connected between the rollers on the lower shaft below the conveyor means, said engaging means and said gripper margin separating means being on respective ones of said bars.

3. An improved gripper margin removal means as claimed in claim 2 in which said bars are on the trailing side of said notches relative to the direction of rotation of said rollers.

4. An improved gripper margin removal means as claimed in claim 1 in which each of said pair of roller means comprises a plurality of rollers and a common shaft on which said rollers are mounted at spaced intervals with the rollers on one shaft opposed to the rollers on the other shaft, arranged to receive the blank therebetween, said rollers having said notches therein, said rollers being arranged to rollingly support the blank conveyed therebetween.

* * * * *